US008591260B2

(12) United States Patent
Davis et al.

(10) Patent No.: US 8,591,260 B2
(45) Date of Patent: Nov. 26, 2013

(54) GROUNDING STRUCTURES FOR HEADER AND RECEPTACLE ASSEMBLIES

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 167 days.

(21) Appl. No.: 13/182,237

(22) Filed: Jul. 13, 2011

(65) Prior Publication Data

US 2013/0017726 A1 Jan. 17, 2013

(51) Int. Cl.
*H01R 9/03* (2006.01)

(52) U.S. Cl.
USPC ..... 439/607.55

(58) Field of Classification Search
USPC ..... 439/607.55, 607.28, 607.32, 408, 701, 439/941
See application file for complete search history.

(56) References Cited

U.S. PATENT DOCUMENTS 6,540,558 B1 * 4/2003 Paagman ..... 439/607.11
6,551,140 B2 * 4/2003 Billman et al. ..... 439/607.07
7,789,708 B2 * 9/2010 Laurx et al. ..... 439/108
7,878,853 B2 * 2/2011 Amleshi et al. ..... 439/607.08
8,062,070 B2 * 11/2011 Jeon et al. ..... 439/620.22
8,187,034 B2 * 5/2012 Fedder et al. ..... 439/607.01
8,226,441 B2 * 7/2012 Regnier et al. ..... 439/626
8,371,876 B2 * 2/2013 Davis ..... 439/607.07

* cited by examiner

*Primary Examiner* — Jean F Duverne

(57) ABSTRACT

A receptacle assembly includes a front housing configured for mating with a header assembly and a contact module coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame that supports the contacts. The dielectric frame is received in the conductive holder. The contacts extend from the conductive holder for electrical termination. A first ground shield is coupled to the first side, is electrically connected to the conductive holder and has grounding beams and grounding fingers that extend forward of the front of the conductive holder for electrical connection to a corresponding header shield of the header assembly. A second ground shield is coupled to the second side, is electrically connected to the conductive holder and has grounding beams and grounding fingers that extend forward of the front of the conductive holder for electrical connection to a corresponding header shield of the header assembly.

20 Claims, 5 Drawing Sheets

GROUNDING STRUCTURES FOR HEADER AND RECEPTACLE ASSEMBLIES

BACKGROUND OF THE INVENTION

The subject matter herein relates generally to grounding connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact.

A need remains for an electrical system that provides efficient shielding to meet particular performance demands. A need remains for an electrical system that provides redundant grounding connections.

BRIEF DESCRIPTION OF THE INVENTION

In one embodiment, a receptacle assembly is provided having a front housing configured for mating with a header assembly. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame that supports the contacts. The dielectric frame is received in the conductive holder. The contacts extend from the conductive holder for electrical termination. A first ground shield is coupled to the first side. The first ground shield is electrically connected to the conductive holder. The first ground shield has grounding beams that extend therefrom. The first ground shield has grounding fingers that extend therefrom. The grounding beams and grounding fingers extend forward of the front of the conductive holder for electrical connection to a corresponding header shield of the header assembly. A second ground shield is coupled to the second side. The second ground shield is electrically connected to the conductive holder. The second ground shield has grounding beams that extend therefrom. The second ground shield has grounding fingers that extend therefrom. The grounding beams and grounding fingers extend forward of the front of the conductive holder for electrical connection to a corresponding header shield of the header assembly.

In another embodiment, a receptacle assembly is provided having a front housing configured for mating with a header assembly. The front housing has contact openings therethrough. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame that support the contacts. The dielectric frame is received in the conductive holder. The contacts extend from the conductive holder into corresponding contact openings for electrical termination to header contacts of the header assembly. A first ground shield is coupled to the first side. The first ground shield is electrically connected to the conductive holder. The first ground shield has grounding beams that extend therefrom. The first ground shield has grounding fingers that extend therefrom. The grounding beams and grounding fingers extend forward of the front of the conductive holder into corresponding contact openings for electrical connection to a wall and an edge, respectively, of a corresponding C-shaped header shield of the header assembly. A second ground shield coupled to the second side. The second ground shield is electrically connected to the conductive holder. The second ground shield has grounding beams that extend therefrom. The second ground shield has grounding fingers that extend therefrom. The grounding beams and grounding fingers extend forward of the front of the conductive holder into corresponding contact openings for electrical connection to a wall and an edge, respectively, of a corresponding C-shaped header shield of the header assembly.

In a further embodiment, an electrical connector assembly is provided having a header assembly that includes a header housing. A plurality of header contacts are held by the header housing, and a plurality of C-shaped header shields surround corresponding header contacts on three sides. The header shields have walls defining the C-shaped header shields and two edges at the ends of the C-shaped header shields. A receptacle assembly is matable to the header assembly. The receptacle assembly includes a front housing that is matable to the header housing. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder for electrical termination to corresponding header contacts. A first ground shield is coupled to the first side. The first ground shield is electrically connected to the conductive holder. The first ground shield has grounding beams that extend therefrom. The first ground shield has grounding fingers extending therefrom, the grounding beams extending forward of the front of the conductive holder for electrical connection to a corresponding wall of a corresponding header shield. The grounding fingers extend forward of the front of the conductive holder for electrical connection to corresponding edges of the header shield. A second ground shield is coupled to the second side. The second ground shield is electrically connected to the conductive holder. The second ground shield has grounding beams that extend therefrom.

The second ground shield has grounding fingers that extend therefrom. The grounding beams extend forward of the front of the conductive holder for electrical connection to a corresponding wall of a corresponding header shield. The grounding fingers extend forward of the front of the conductive holder for electrical connection to corresponding edges of the header shield.

DETAILED DESCRIPTION OF THE INVENTION

Figure 1:
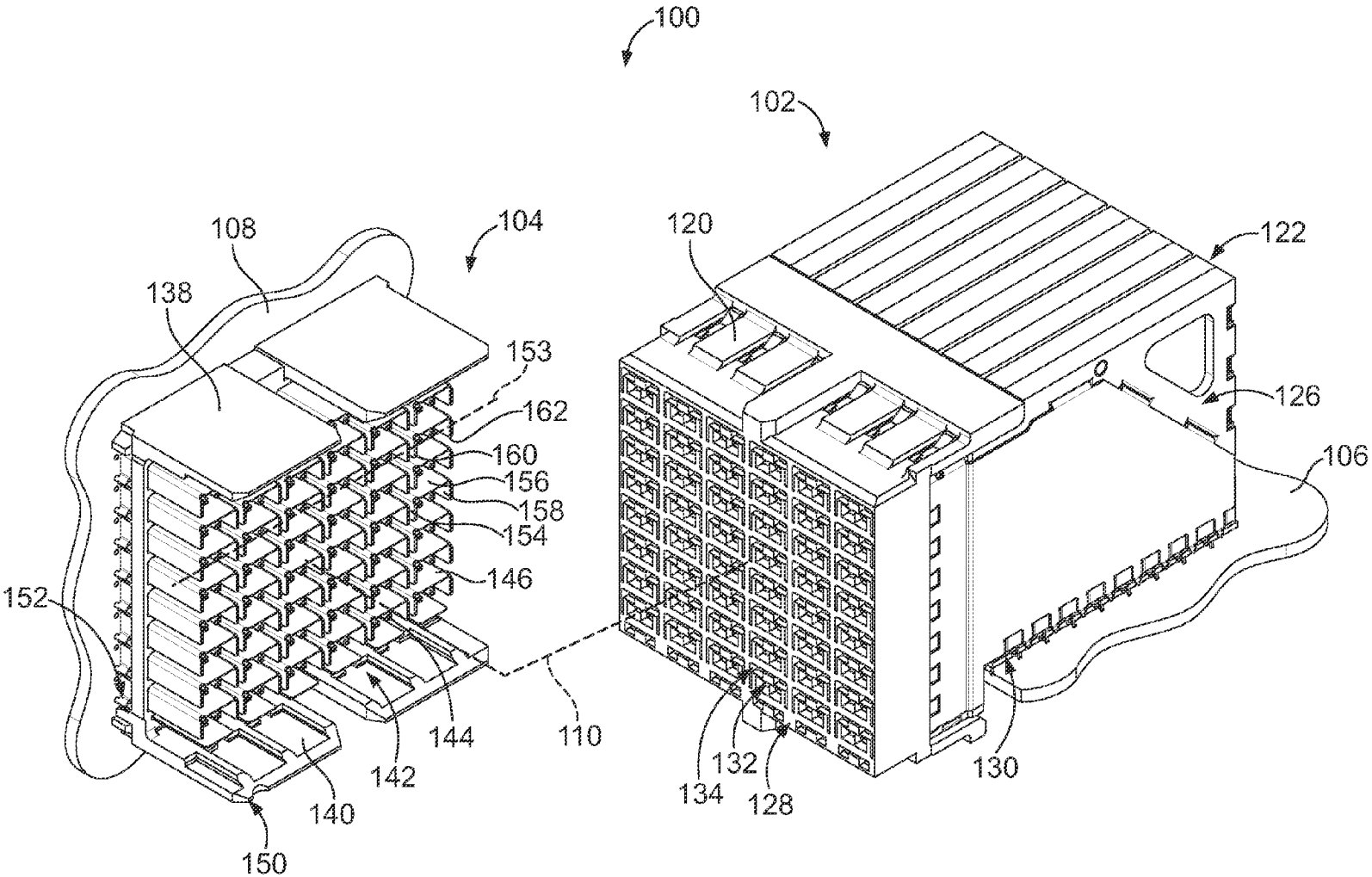
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302, 332 (shown in FIG. 2) and grounding fingers 303, 340 (shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides the shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
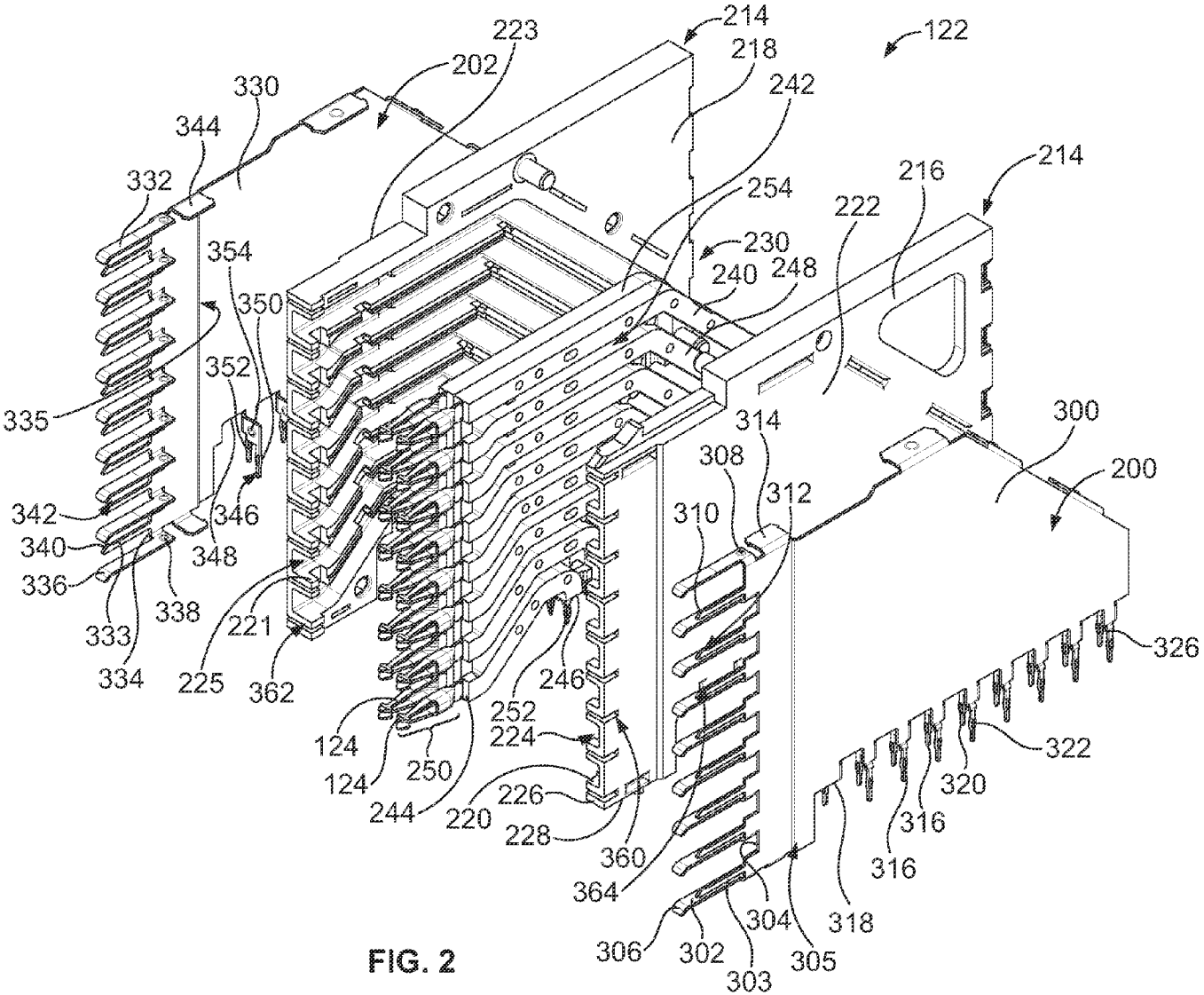
FIG. 2 is an exploded view of one of the contact modules and part of a shield structure shown in FIG. 1.

FIG. 2 is an exploded view of one of the contact modules 122 and part of the shield structure 126. The shield structure 126 includes a first ground shield 200 and a second ground shield 202. The first and second ground shields 200, 202 electrically connect the contact module 122 to the header shields 146 (shown in FIG. 1). The first and second ground shields 200, 202 provide multiple, redundant points of contact to the header shield 146. The first and second ground shields 200, 202 provide shielding on all sides of the receptacle signal contacts 124.

The contact module 122 includes a holder 214 having a first holder member 216 and a second holder member 218 that are coupled together to form the holder 214. The holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle assembly 102. When the holder members 216, 218 are coupled together, the holder members 216, 218 define at least a portion of the shield structure 126 of the receptacle assembly 102.

The holder members 216, 218 include tabs 220, 221 extending inward from side walls 222, 223 thereof. The tabs 220 define channels 224 therebetween. The tabs 221 define channels 225 therebetween. The tabs 220, 221 define at least a portion of the shield structure 126 of the receptacle assembly 102. When assembled, the holder members 216, 218 are coupled together and define a front 226 and a bottom 228 of the holder 214.

The contact module 122 includes a frame assembly 230 held by the holder 214. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the contact modules 122 other than overmolding a lead frame, such as loading receptacle signal contacts 124 into a formed dielectric body.

The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 214 and the contact tails 252 extend downward from the bottom 228 of the holder 214.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frame 240 and corresponding receptacle signal contacts 124 are coupled to the holder member 216. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are coupled to the holder member 218 in a similar manner with the tabs 221 extending through the dielectric frame 242.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the frames 240, and thus around the outside of all of the receptacle signal contacts 124, such as between pairs of receptacle signal contacts 124, as well as between the receptacle signal contacts 124 using the tabs 220, 221 to control electrical characteristics, such as impedance control, cross-talk control, and the like, of the receptacle signal contacts 124.

The first ground shield 200 includes a main body 300. In the illustrated embodiment, the main body 300 is generally planar. The ground shield 200 includes grounding beams 302 and grounding fingers 303 extending forward from a front 304 of the main body 300. In an exemplary embodiment, the grounding beams 302 are bent inward out of plane with respect to the main body 300 such that the grounding beams 302 are oriented perpendicular with respect to the plane defined by the main body 300. The grounding beams 302 are bent inward toward the holder 214. In an exemplary embodiment, the grounding fingers 303 are arranged in the plane defined by the main body 300, however the grounding fingers 303 may be bent out of plane in alternative embodiments. In an exemplary embodiment, the main body 300 includes a jogged section 305 that jogs a front section of the main body 300 with respect to a rear section of the main body 300. The front and rear sections extend parallel to one another and, while not exactly coplanar, together generally define a plane of the main body 300. The jogged section 305 allows the front section to be positioned with respect to the rear section, such as to position the grounding fingers 303 and/or ground pins 316 in particular locations.

In an exemplary embodiment, the first ground shield 200 is manufactured from a metal material. The ground shield 200 is a stamped and formed part with the grounding fingers 303 being stamped and the grounding beams 302 being stamped and then bent during the forming process out of plane with respect to the main body 300. Optionally, the main body 300 may extend vertically while the grounding beams 302 may extend horizontally, however other orientations are possible in alternative embodiments.

Each grounding beam 302 has a mating interface 306 at a distal end thereof. The mating interface 306 is configured to engage the corresponding header shield 146. The grounding beam 302 includes one or more projections 308 extending therefrom. The projections 308 are configured to engage the conductive holder 214 when the ground shield 200 is coupled thereto. The grounding beams 302 are configured to extend forward from the front 226 of the holder 214 such that the grounding beams 302 may be loaded into the front housing 120 (shown in FIG. 1).

Each grounding finger 303 has a mating interface 310 at a distal end thereof. In an exemplary embodiment, the grounding fingers 303 have bumps 312 proximate to the distal ends that are upward facing and that define the mating interfaces 310. The mating interfaces 310 are configured to engage the edges 160 (shown in FIG. 1) of corresponding header shields 146. The grounding fingers 303 are configured to extend forward from the front 226 of the holder 214 such that the grounding fingers 303 may be loaded into the front housing 120.

The grounding fingers 303 are offset horizontally and vertically with respect to the grounding beams 302. The grounding fingers 303 may extend along the sides of the receptacle signal contacts 124. The grounding fingers 303 may provide shielding between the receptacle signal contacts 124 and receptacle signal contacts 124 of an adjacent contact module 122 held in the receptacle assembly 102. The grounding fingers 303 may be generally vertically aligned with receptacle signal contacts 124 in a corresponding row of the receptacle signal contacts 124. The grounding fingers 303 may be vertically offset, such as below, the receptacle signal contacts 124.

The first ground shield 200 includes a plurality of mounting tabs 314 extending inward from the main body 300. The mounting tabs 314 are configured to be coupled to the holder member 216. The mounting tabs 314 secure the first ground shield 200 to the first side wall 222. The mounting tabs 314 engage the holder member 216 to electrically connect the first ground shield 200 to the holder member 216. Any number of mounting tabs 314 may be provided. The location of the mounting tabs 314 may be selected to secure various portions of the first ground shield 200, such as the top, the back, the front, the bottom, and the like of the first ground shield 200 to the holder member 216. The engagement of the projections 308 with the holder 214 help to secure the ground shield 200 to the holder 214.

The first ground shield 200 includes a plurality of ground pins 316 extending from a bottom 318 of the first ground shield 200. The ground pins 316 are configured to be terminated to the circuit board 106 (shown in FIG. 1). The ground pins 316 may be compliant pins, such as eye-of-the-needle pins, that are through-hole mounted to plated vias in the circuit board 106. Other types of termination means or features may be provided in alternative embodiments to couple the first ground shield 200 to the circuit board 106.

In an exemplary embodiment, the ground pins 316 include internal ground pins 320 and external ground pins 322. The internal ground pins 320 are configured to extend into the holder member 216. The external ground pins 322 remain outside and along the first side wall 222 of the holder member 216. The internal ground pins 320 are configured to be positioned between, and generally aligned with, the contact tails 252. The internal ground pins 320 are generally located in the column of receptacle signal contacts 124 to provide shielding between the receptacle signal contacts held by the dielectric frame 240. Optionally, the internal ground pins 320 may be stamped and then bent inward during the forming process out of plane with respect to the main body 300. The internal ground pins 320 may include one or more projections (not shown) extending therefrom. The projections are configured to engage the conductive holder 214 when the ground shield 200 is coupled thereto.

The external ground pins 322 are offset with respect to the receptacle signal contacts outside of the envelope of the holder 214. The external ground pins 322 are located to provide shielding between the receptacle signal contacts 124 of the contact module 122 and receptacle signal contacts 124 of an adjacent contact module 122 within the receptacle assembly 102. For example, the external ground pins 322 are generally aligned with the interface between two adjacent contact modules 122. The external ground pins 322 may be generally aligned with the plane of the main body 300 of the first ground shield 200. Optionally, the external ground pins 322 may include a jogged section 326 that slightly shifts the external ground pins 322 out of the plane of the main body 300, such as to align the external ground pins 322 with external ground pins of the adjacent contact module 122.

The second ground shield 202 includes a main body 330. In the illustrated embodiment, the main body 330 is generally planar. The second ground shield 202 includes grounding beams 332 and grounding fingers 333 extending forward from a front 334 of the main body 330. In an exemplary embodiment, the grounding beams 332 are bent inward out of plane with respect to the main body 330 such that the grounding beams 332 are oriented perpendicular with respect to the plane defined by the main body 330. The grounding beams 332 are bent inward toward the holder 214. In an exemplary embodiment, the grounding fingers 333 are arranged in the plane defined by the main body 330, however the grounding fingers 333 may be bent out of plane in alternative embodiments. In an exemplary embodiment, the main body 330 includes a jogged section 335 that jogs a front section of the main body 330 with respect to a rear section of the main body 330. The front and rear sections extend parallel to one another and, while not exactly coplanar, together generally define a plane of the main body 330. The jogged section 335 allows the front section to be positioned with respect to the rear section, such as to position the grounding fingers 333 and/or ground pins 346 in particular locations.

In an exemplary embodiment, the second ground shield 202 is manufactured from a metal material. The ground shield 202 is a stamped and formed part with the grounding fingers 333 being stamped and the grounding beams 332 being stamped and then bent during the forming process out of plane with respect to the main body 330. Optionally, the main body 330 may extend vertically while the grounding beams 332 may extend horizontally, however other orientations are possible in alternative embodiments.

Each grounding beam 332 has a mating interface 336 at a distal end thereof. The mating interface 336 is configured to engage the corresponding header shield 146. The grounding beam 332 includes one or more projections 338 extending therefrom. The projections 338 are configured to engage the conductive holder 214 when the ground shield 202 is coupled thereto. The grounding beams 332 are configured to extend forward from the front 226 of the holder 214 such that the grounding beams 332 may be loaded into the front housing 120 (shown in FIG. 1).

Each grounding finger 333 has a mating interface 336 at a distal end thereof. In an exemplary embodiment, the grounding fingers 333 have bumps 342 proximate to the distal ends that are upward facing and that define the mating interfaces 340. The mating interfaces 340 are configured to engage the edges 162 (shown in FIG. 1) of corresponding header shields 146. The grounding fingers 333 are configured to extend forward from the front 226 of the holder 214 such that the grounding beams 332 may be loaded into the front housing 120.

The grounding fingers 333 are offset horizontally and vertically with respect to the grounding beams 332. The grounding fingers 333 may extend along the sides of the receptacle signal contacts 124. The grounding fingers 333 may provide shielding between the receptacle signal contacts 124 and receptacle signal contacts 124 of an adjacent contact module 122 held in the receptacle assembly 102. The grounding fingers 333 may be generally vertically aligned with receptacle signal contacts 124 in a corresponding row of the receptacle signal contacts 124. The grounding fingers 333 may be vertically offset, such as below, the receptacle signal contacts 124.

The second ground shield 202 includes a plurality of mounting tabs 344 extending inward from the main body 330. The mounting tabs 344 are configured to be coupled to the holder member 218. The mounting tabs 344 secure the second ground shield 202 to the second side wall 223. The mounting tabs 344 engage the holder member 218 to electrically connect the second ground shield 202 to the holder member 218. Any number of mounting tabs 344 may be provided. The location of the mounting tabs 344 may be selected to secure various portions of the second ground shield 202, such as the top, the back, the front, the bottom, and the like of the second ground shield 202 to the holder member 218. The engagement of the projections 338 with the holder 214 help to secure the ground shield 202 to the holder 214.

The second ground shield 202 includes a plurality of ground pins 346 extending from a bottom 348 of the second ground shield 202. The ground pins 346 are configured to be terminated to the circuit board 106 (shown in FIG. 1). The ground pins 346 may be compliant pins, such as eye-of-the-needle pins, that are through-hole mounted to plated vias in the circuit board 106. Other types of termination means or features may be provided in alternative embodiments to couple the second ground shield 202 to the circuit board 106.

In an exemplary embodiment, the ground pins 346 include internal ground pins 350 and external ground pins 352. The internal ground pins 350 are configured to extend into the holder member 218. The external ground pins 352 remain outside and along the second side wall 223 of the holder member 218. The internal ground pins 350 are configured to be positioned between, and generally aligned with, the contact tails 252. The internal ground pins 350 are located in the column of receptacle signal contacts 124 to provide shielding between the receptacle signal contacts held by the dielectric frame 242. Optionally, the internal ground pins 350 may be stamped and then bent inward during the forming process out of plane with respect to the main body 300. The internal ground pins 350 include one or more projections 354 extending therefrom. The projections 354 are configured to engage the conductive holder 214 when the ground shield 202 is coupled thereto.

The external ground pins 352 are offset with respect to the receptacle signal contacts outside of the envelope of the holder 214. The external ground pins 352 are located to provide shielding between the receptacle signal contacts 124 of the contact module 122 and receptacle signal contacts 124 of an adjacent contact module 122 within the receptacle assembly 102. For example, the external ground pins 352 are generally aligned with the interface between two adjacent contact modules 122. The external ground pins 352 may be generally aligned with the plane of the main body 330 of the second ground shield 202. Optionally, the external ground pins 352 may include a jogged section (not shown) that slightly shifts the external ground pins 352 out of the plane of the main body 330, such as to align the external ground pins 352 with external ground pins of the adjacent contact module 122.

In an exemplary embodiment, the holder members 216, 218 include slots 360, 362, respectively, in the fronts thereof that receive the grounding beams 302, 332, respectively, therein when the ground shields 200, 202 are coupled thereto. The projections 308, 338 are received in the slots 360, 362 and engage the holder members 216, 218 to create an electrical connection with the holder members 216, 218. In an exemplary embodiment, the slots 360, 362 are vertically offset with respect to the receptacle signal contacts 124. When the grounding beams 302, 332 are received in the slots 360, 362, the grounding beams 302, 332 are vertically offset with respect to the receptacle signal contacts 124. For example, the grounding beams 302, 332 may be positioned above and/or below corresponding receptacle signal contacts 124. In an exemplary embodiment, the grounding beams 302 are generally vertically aligned with the receptacle signal contacts 124 of the dielectric frame 240 and the grounding beams 332 are generally vertically aligned with the receptacle signal contacts 124 of the dielectric frame 242. The grounding beams 302, 332 provide electrical shielding between the receptacle signal contacts 124 in different rows.

In an exemplary embodiment, the holder members 216, 218 include slots 364, 366 (shown in FIG. 4), respectively, in the bottoms thereof that receive the internal ground pins 320, 350, respectively, therein when the ground shields 200, 202 are coupled thereto. The projections 354 are received in the slots 366 and engage the holder member 218 to create an electrical connection with the holder member 218. In an exemplary embodiment, the slots 364, 366 are offset with respect to the receptacle signal contacts 124. When the internal ground pins 320, 350 are received in the slots 364, 366, the internal ground pins 320, 350 are positioned between the receptacle signal contacts 124. For example, the internal ground pins 320, 350 may be positioned forward and/or rearward of corresponding receptacle signal contacts 124. In an exemplary embodiment, the internal ground pins 320 are generally aligned (e.g. front-to-back) with the receptacle signal contacts 124 of the dielectric frame 240 and the internal ground pins 350 are generally aligned (e.g. front-to-back) with the receptacle signal contacts 124 of the dielectric frame 242.

Figure 3:
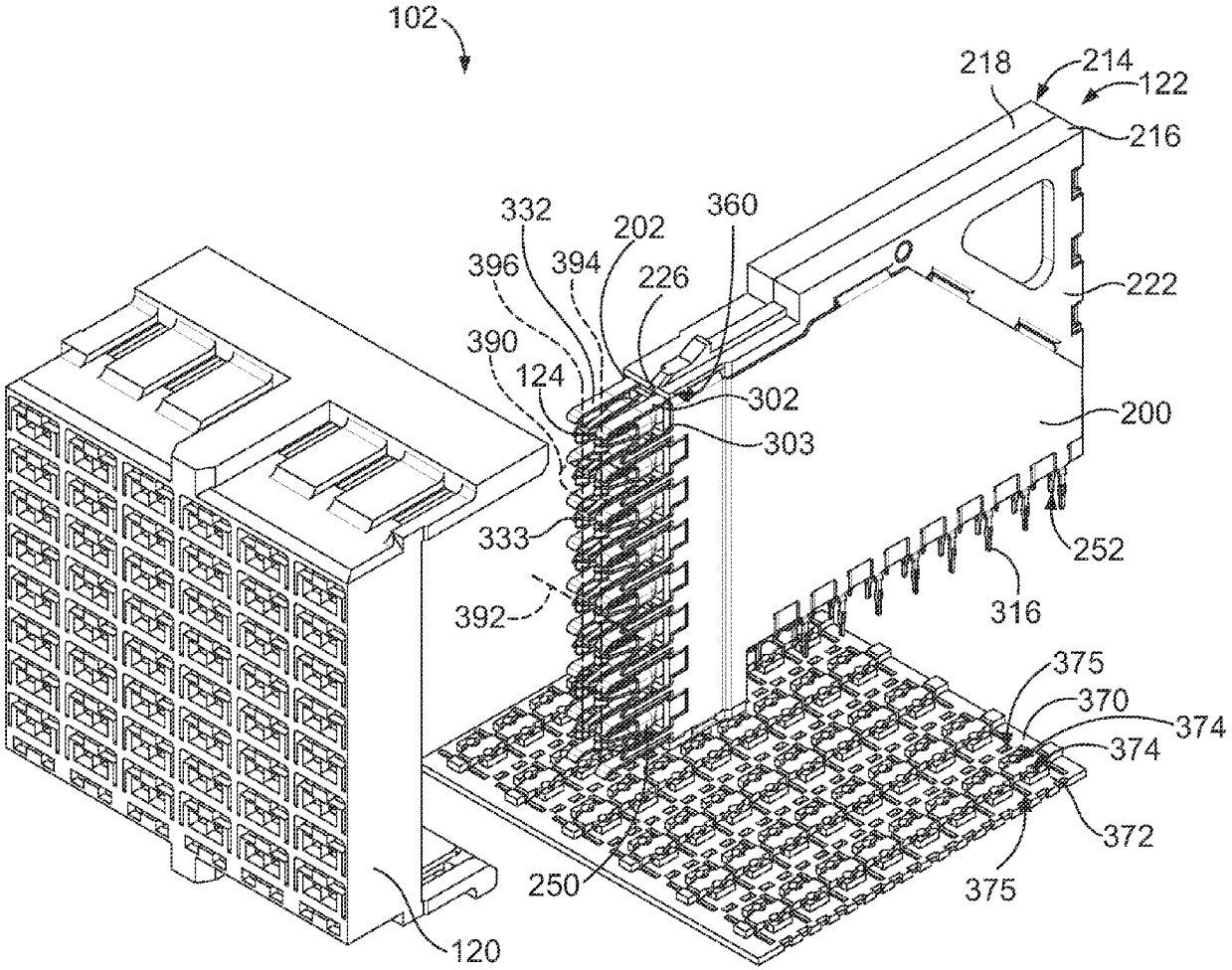
FIG. 3 is an exploded view of a receptacle assembly showing one of the contact modules poised for loading into the front housing as shown in FIG. 1.

FIG. 3 is an exploded view of the receptacle assembly 102 showing one of the contact modules 122 poised for loading into the front housing 120. FIG. 3 also illustrates a contact spacer 370 used to organize and/or hold the contact tails 252 and ground pins 316, 346 (shown in FIG. 2). Only one contact module 122 is illustrated in FIG. 3, and it is realized that any number of contact modules 122 may be loaded into the front housing 120 during assembly of the receptacle assembly 102.

Figure 4:
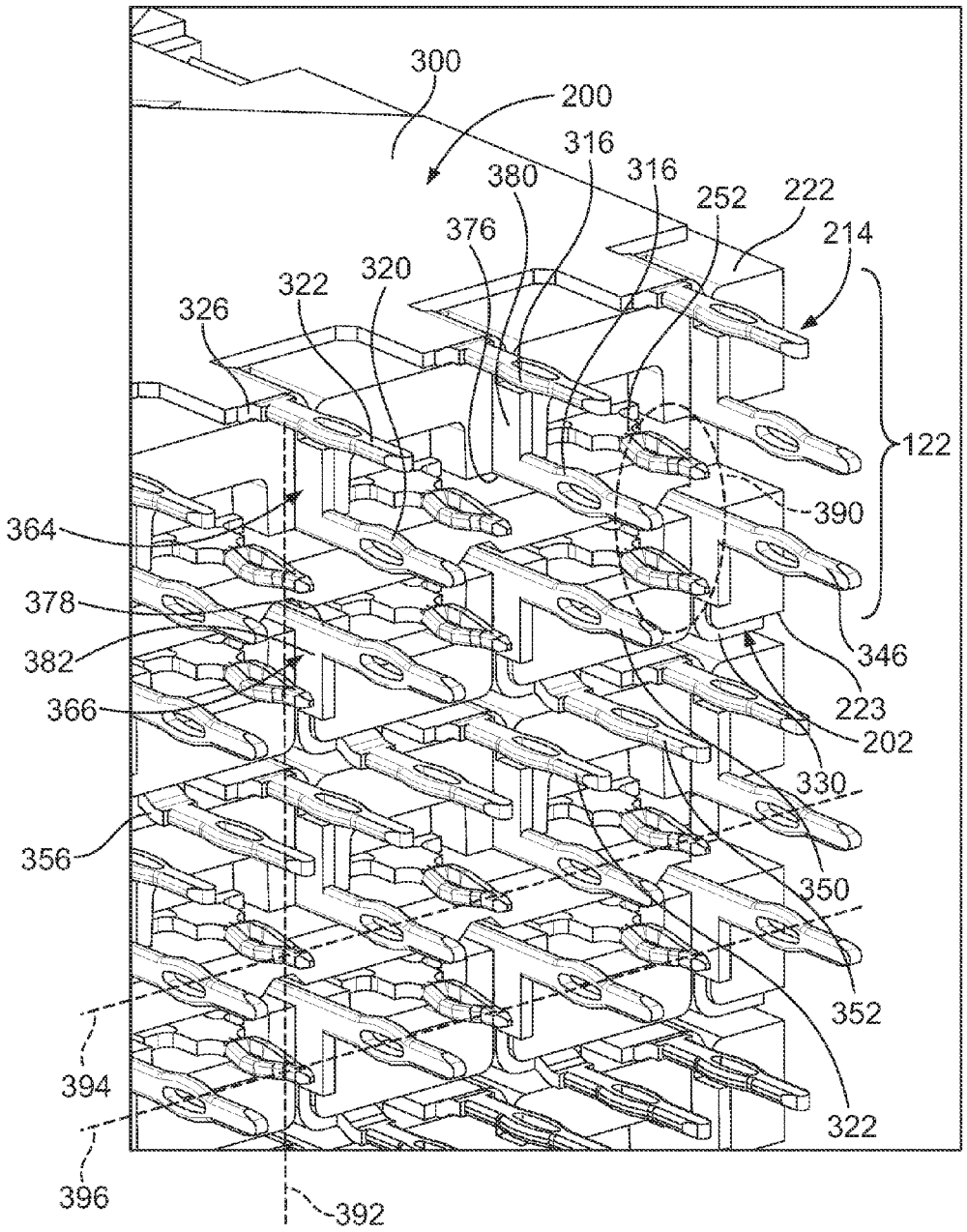
FIG. 4 is an enlarged view of a portion of a bottom of the receptacle assembly shown in FIG. 3 with a contact spacer thereof removed for clarity.

During assembly of the contact module 122, the dielectric frames 240, 242 (shown in FIG. 2) are received in the corresponding holder members 216, 218. The holder members 216, 218 are coupled together and generally surround the dielectric frames 240, 242. The dielectric frames 240, 242 are aligned adjacent one another such that the receptacle signal contacts 124 are aligned with one another and define contact pairs 390. Each contact pair 390 is configured to transmit differential signals through the contact module 122. The receptacle signal contacts 124 within each contact pair 390 are arranged in rows that extend along row axes 392. The receptacle signal contacts 124 within the dielectric frame 240 are arranged within a column along a column axis 394. Similarly, the receptacle signal contacts 124 of the dielectric frame 242 are arranged in a column along a column axis 396. In the illustrated embodiment, at the mating end 128, the rows are oriented horizontally and the columns are oriented vertically, however it is noted that at the contact tails 252, the columns, and thus the column axes 394, 396, as shown in FIG. 4, are oriented horizontally. Other orientations are possible in alternative embodiments.

The first and second ground shields 200, 202 are coupled to the holder 214 to provide shielding for the receptacle signal contacts 124. When assembled, the first ground shield 200 is positioned exterior of, and along, the first side wall 222. The grounding beams 302 extend into the slots 360 and are generally aligned with the mating portions 250 along the column axis 394. The grounding fingers 303 extend forward from the front 226 and are positioned outside of the receptacle signal contacts 124. The grounding fingers 303 are generally aligned with the mating portions 250 along the row axes 392. Optionally, the grounding fingers 303 may be offset (e.g. positioned below) with respect to the centerline of the mating portions 250, however the grounding fingers 303 may still be horizontally aligned with a portion of the mating portions 250 (e.g. a bottom edge of the mating portions 250). The first and second ground shields 200, 202 are configured to be electrically connected to the header shields 146 when the receptacle assembly 102 is coupled to the header assembly 104 (both shown in FIG. 1).

The grounding beams 302, 332 provide shielding for the receptacle signal contacts 124 in the dielectric frame 240 and the dielectric frame 242, respectively. The grounding beams 302, 332 are aligned with the contact pairs 390 along the column axis 394 and the column axis 396. In an exemplary embodiment, one set of grounding beams 302, 332 is provided below the lowermost contact pair 390, another set of grounding beams 302, 332 is provided above the uppermost contact pair 390, and other sets of grounding beams 302 are provided between each of the contact pairs 390. Each of the contact pairs 390 is thereby shielded both above and below its respective row axis 392.

The grounding fingers 303, 333 extend forward from the front 226 along the sides of the contact pairs 390. The grounding fingers 303, 333 are generally aligned with the contact pairs 390 along the row axes 392. The grounding fingers 303, 333 are vertically offset with respect to the grounding beams 302, 332. During use, the grounding fingers 303, 333 are generally aligned horizontally with the contact pairs 390 while the grounding beams 302, 332 are positioned vertically between the contact pairs 390. The grounding fingers 303, 333 are horizontally offset with respect to the grounding beams 302, 332. For example, the grounding beams 302, 332 are generally aligned with the column axes 394, 396, while the grounding fingers 303, 333 are offset horizontally outside of the column axes 394, 396.

The contact spacer 370 includes a base 372 having a plurality of openings 374, 375 therethrough. The base 372 is manufactured from a dielectric material. The openings 374 are configured to receive corresponding contact tails 252 and the openings 375 are configured to receive ground pins 316, 346. The openings 374, 375 are arranged in rows and columns that correspond to the positioning of the contact tails 252 and ground pins 316, 346. Openings 375 for the ground pins 316, 346 tend to surround (e.g. forward, rearward, and both sides) the openings 374 for the contact tails 252. The ground pins 316, 346 are positioned all around the pairs of contact tails 252. In an exemplary embodiment, a column of openings 375 for the ground pins 316, 346 is arranged between each pair of columns of openings 374 for the contact tails 252 that receive the pair 390 of contacts associated with each contact module 122. Openings 375 for the ground pins 316, 346 are arranged between each pair of openings 374 for the contact tails 252 of a corresponding pair 390 of contacts. Other configurations of openings 374, 375 are possible in alternative embodiments.

The contact spacer 370 holds the contact tails 252 and ground pins 316, 346 at predetermined positions for mating with the circuit board 106. The contact spacer 370 is coupled to all of the contact modules 122 after all of the contact modules 122 are received in the front housing 120. The receptacle assembly 102 may then be mounted to the circuit board 106 as a unit.

FIG. 4 is an enlarged view of a portion of the bottom of the receptacle assembly 102 with the contact spacer 370 (shown in FIG. 3) removed for clarity. Portions of two contact modules 122 are shown in FIG. 4. The ground shields 200, 202 are coupled to the holders 214. The ground pins 316, 346 extend from the ground shields 200, 202 into shielding positions around the contact pairs 390. The internal ground pins 320 extend into the slots 364. When positioned next to another contact module 122, the external ground pins 322 are provided along the first side wall 222 generally aligned along the interface between the contact modules 122. When positioned next to another contact module 122, the external ground pins 322 are interspersed with the external ground pins 352 of the other contact module 122. The internal ground pins 350 extend into the slots 366. When positioned next to another contact module 122, the external ground pins 352 are provided along the second side wall 223 generally aligned along the interface between the contact modules 122. When positioned next to another contact module 122, the external ground pins 352 are interspersed with the external ground pins 322 of the other contact module 122.

The internal ground pins 320, 350 are generally aligned with the contact tails 252 along the column axes 394, 396, respectively. The internal ground pins 320, 350 are interspersed between each pair of contact tails 252. The internal ground pins 320, 350 are provided at distal ends 376, 378 of tabs 380, 382 that are bent or folded in from the main bodies 300, 330.

The external ground pins 322, 352 are positioned between the columns of contact tails 252. Optionally, the external ground pins 322, 352 may be offset rearward and forward, respectively, of the row axes 392 such that the external ground pins 322, 352 are not directly in line with the contact tails 252, but rather are staggered slightly forward and rearward of the contact tails 252. Having external ground pins 322, 352 from both ground shields 200, 202 between the contact modules 122 in essence doubles the number of ground pins between the contact tails 252, thereby providing additional shielding for the receptacle signal contacts 124. The positioning of the ground pins 322, 352 may be selected to allow room for traces to be routed in the circuit board. In an exemplary embodiment, jogged sections 326 on the external ground pins 322 and corresponding jogged sections 356 on the external ground pins 352 position the external ground pins 322, 352 in a single column by jogging the external ground pins 322 toward the adjacent contact module 122 and by jogging the external ground pins 352 toward the adjacent contact module 122. The amount of jog may be selected to align the external ground pins 322, 352. Alternatively, the external ground pins 352 may not be jogged and may be arranged in two columns that are slightly offset.

Figure 5:
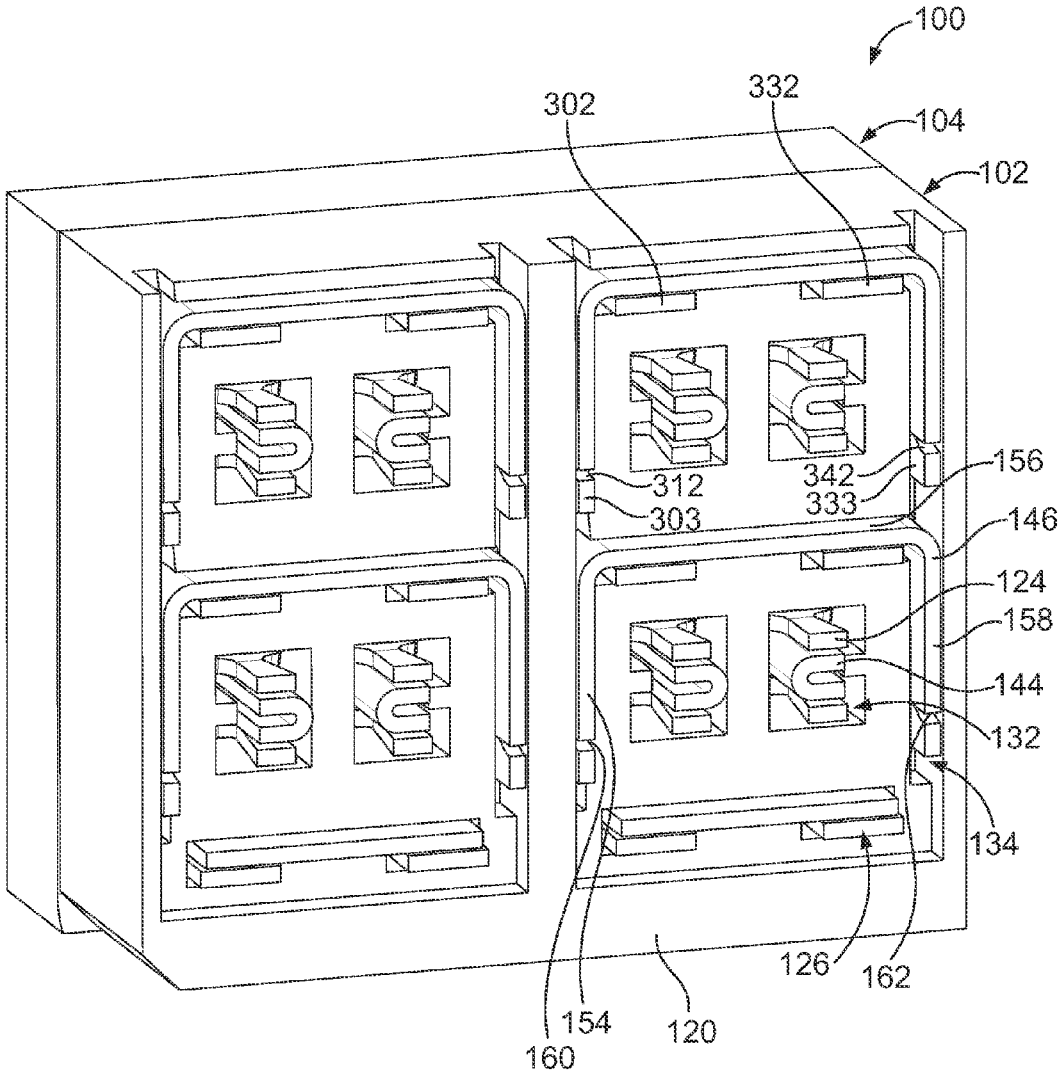
FIG. 5 is a partial sectional view of a portion of the electrical connector system showing the receptacle assembly mated to the header assembly shown in FIG. 1.

FIG. 5 is a partial sectional view of a portion of the electrical connector system 100 showing the receptacle assembly 102 mated to the header assembly 104. The grounding electrical connection between the shield structure 126 and the header shields 146 is illustrated in FIG. 5. The first and second ground shields 200, 202 (shown in FIG. 2) are electrically connected to corresponding header shields 146.

The front housing 120 of the receptacle assembly 102 includes the signal contact openings 132 and the ground contact openings 134. When the header assembly 104 and receptacle assembly 102 are mated, the header signal contacts 144 are mated to the receptacle signal contacts 124 within the signal contact openings 132. The header shields 146 are received in the ground contact openings 134. The grounding beams 302, 332 engage and are electrically connected to corresponding header shields 146 within the ground contact openings 134. The grounding beams 302, 332 engage the center wall 156 of the C-shaped header shields 146 to make electrical connection therewith.

The grounding fingers 303, 333 engage and are electrically connected to corresponding header shields 146 within the ground contact openings 134. Optionally, the grounding fingers 303, 333 and header shields 146 have approximately equal thicknesses such that the grounding fingers 303, 333 and header shields 146 can both be received in the ground contact openings 134. Optionally, the width of the ground contact openings 134 may be substantially equal to the thicknesses of the grounding fingers 303, 333 and header shields 146 such that the grounding fingers 303, 333 do not slip off of the edges 160, 162. The grounding fingers 303, 333 engage the edges 160, 162 of the C-shaped header shields 146 to make electrical connection therewith.

In an exemplary embodiment, the grounding beams 302, 332 and the grounding fingers 303, 333 are deflectable and are configured to be spring biased against the header shields 146 to ensure electrical connection with the header shields 146. The bumps 312, 342 on the grounding fingers 303, 333 are upward facing and engage the bottom edges 160, 162, respectively, to ensure electrical connection between the ground shields 200, 202 and the header shield 146.

In an exemplary embodiment, the header shields 146 and the shield structure 126 provide 360° shielding for the receptacle signal contacts 124. For example, the side wall 154 and the grounding fingers 303 both extend along first sides of the receptacle signal contacts 124 to provide shielding along such sides of the receptacle signal contacts 124. The side wall 158 and the grounding fingers 333 both extend along second sides of the receptacle signal contacts 124 to provide shielding along such sides of the receptacle signal contacts 124. The header shields 146 and grounding fingers 303, 333 thus provide shielding between corresponding columns of the receptacle signal contacts 124, such as between receptacle signal contacts 124 held within different contact modules 122. The grounding beams 302, 332 and the center wall 156 both extend along the receptacle signal contacts 124. The center wall 156 and grounding beams 302, 332 provide shielding between receptacle signal contacts 124 in different rows.

The shield structure 126 has multiple, redundant points of contact with each of the C-shaped header shields 146. For example, four points of contact are defined by the grounding fingers 303, 333 and the grounding beams 302, 332. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing configured for mating with a header assembly; and a plurality of contact modules coupled to the front housing, each contact module comprising:

a conductive holder having a first side and an opposite second side, the conductive holder having a front coupled to the front housing:

a frame assembly comprising a plurality of contacts and a dielectric frame supporting the contacts, the dielectric frame being received in the conductive holder such that the conductive holder surrounds the frame assembly and provides electrical shielding around the frame assembly, the contacts extending from the conductive holder for electrical termination;

a first ground shield discrete from the conductive holder and coupled to the first side of the conductive holder, the first ground shield being electrically connected to the conductive holder, the first ground shield having grounding beams extending therefrom, the first ground shield having grounding fingers extending therefrom, the grounding beams and grounding fingers extending forward of the front of the conductive holder for electrical connection to a corresponding header shield of the header assembly; and a second ground shield discrete from the conductive holder and coupled to the second side of the conductive holder, the second ground shield being electrically connected to the conductive holder, the second ground shield having grounding beams extending therefrom, the second ground shield having grounding fingers extending therefrom, the grounding beams and grounding fingers extending forward of the front of the conductive holder for electrical connection to a corresponding header shield of the header assembly.

2. The receptacle assembly of claim 1, wherein the grounding beams and the grounding fingers of the first ground shield are vertically offset with respect to one another, and wherein the grounding beams and the grounding fingers of the second ground shield are vertically offset with respect to one another.

3. The receptacle assembly of claim 1, wherein the first ground shield is coupled to the first side and the second ground shield is coupled to the second side such that the grounding beams of the first ground shield are horizontally aligned with corresponding grounding beams of the second ground shield and such that the grounding fingers of the first ground shield are horizontally aligned with corresponding grounding fingers of the second ground shield.

4. The receptacle assembly of claim 1, wherein the first ground shield is coupled to the first side and the second ground shield is coupled to the second side such that the grounding beams and grounding fingers are arranged in sets, each set includes one grounding beam from the first ground shield, one grounding finger from the first ground shield, one grounding beam from the second ground shield and one grounding finger from the second ground shield, each set configured to engage a corresponding header shield at four redundant points of contact.

5. The receptacle assembly of claim 1, wherein the dielectric frame comprises a first dielectric frame, the contact module further comprising a second dielectric frame supporting contacts, the first and second dielectric frames being held in the conductive holder such that the contacts of the first and second dielectric frames are adjacent one another and define contact pairs, the grounding beams of the first and second ground shields being arranged between corresponding contact pairs, the grounding fingers of the first and second ground shields being arranged on respective opposite sides of corresponding contact pairs.

6. The receptacle assembly of claim 1, wherein the first ground shield includes ground pins extending from a bottom of the first ground shield, the second ground shield includes ground pins extending from a bottom of the second ground shield, the contacts having contact tails extending from a bottom of the contact module, the ground pins of the first ground shield being arranged in a column to one side of the contact tails of the contact module, the ground pins of the second ground shield being arranged in a column on an opposite side of the contact tails of the contact module.

7. The receptacle assembly of claim 1, wherein the first ground shield includes ground pins extending from a bottom of the first ground shield, the contacts having contact tails extending from a bottom of the contact module, the contact tails being arranged along a column axis, the ground pins of the first ground shield being aligned with the column axis.

8. The receptacle assembly of claim 1, wherein the first ground shield includes internal ground pins and external ground pins extending from a bottom of the first ground shield, the contacts have contact tails extending from a bottom of the contact module, the contact tails being arranged along a column axis, the internal ground pins being aligned with the column axis, the external ground pins being arranged in a column to one side of the column axis.

9. A receptacle assembly comprising:

a front housing configured for mating with a header assembly, the front housing having contact openings therethrough;

a contact module coupled to the front housing, the contact module including a conductive holder having a first side and an opposite second side, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder into corresponding contact openings for electrical termination to header contacts of the header assembly;

a first ground shield discrete from the conductive holder and coupled to the first side of the conductive holder, the first ground shield being electrically connected to the conductive holder, the first ground shield having grounding beams extending therefrom, the first ground shield having grounding fingers extending therefrom, the grounding beams and grounding fingers extending forward of the front of the conductive holder into corresponding contact openings for electrical connection to a wall and an edge, respectively, of a corresponding C-shaped header shield of the header assembly; and a second ground shield discrete from the conductive holder and coupled to the second side of the conductive holder, the second ground shield being electrically connected to the conductive holder, the second ground shield having grounding beams extending therefrom, the second ground shield having grounding fingers extending therefrom, the grounding beams and grounding fingers extending forward of the front of the conductive holder into corresponding contact openings for electrical connection to a wall and an edge, respectively, of a corresponding C-shaped header shield of the header assembly.

10. The receptacle assembly of claim 9, wherein the grounding beams and the grounding fingers of the first ground shield are vertically offset with respect to one another, and wherein the grounding beams and the grounding fingers of the second ground shield are vertically offset with respect to one another.

11. The receptacle assembly of claim 9, wherein the first ground shield is coupled to the first side and the second ground shield is coupled to the second side such that the grounding beams of the first ground shield are horizontally aligned with corresponding grounding beams of the second ground shield and such that the grounding fingers of the first ground shield are horizontally aligned with corresponding grounding fingers of the second ground shield.

12. The receptacle assembly of claim 9, wherein the first ground shield is coupled to the first side and the second ground shield is coupled to the second side such that the grounding beams and grounding fingers are arranged in sets, each set includes one grounding beam from the first ground shield, one grounding finger from the first ground shield, one grounding beam from the second ground shield and one grounding finger from the second ground shield, each set configured to engage a corresponding header shield at four redundant points of contact.

13. The receptacle assembly of claim 9, wherein the dielectric frame comprises a first dielectric frame, the contact module further comprising a second dielectric frame supporting contacts, the first and second dielectric frames being held in the conductive holder such that the contacts of the first and second dielectric frames are adjacent one another and define contact pairs, the grounding beams of the first and second ground shields being arranged between corresponding contact pairs, the grounding fingers of the first and second ground shields being arranged on respective opposite sides of corresponding contact pairs.

14. The receptacle assembly of claim 9, wherein the first ground shield includes ground pins extending from a bottom of the first ground shield, the second ground shield includes ground pins extending from a bottom of the second ground shield, the contacts having contact tails extending from a bottom of the contact module, the ground pins of the first ground shield being arranged in a column to one side of the contact tails of the contact module, the ground pins of the second ground shield being arranged in a column on an opposite side of the contact tails of the contact module.

15. The receptacle assembly of claim 9, wherein the first ground shield includes ground pins extending from a bottom of the first ground shield, the contacts having contact tails extending from a bottom of the contact module, the contact tails being arranged along a column axis, the ground pins of the first ground shield being aligned with the column axis.

16. The receptacle assembly of claim 9, wherein the first ground shield includes internal ground pins and external ground pins extending from a bottom of the first ground shield, the contacts have contact tails extending from a bottom of the contact module, the contact tails being arranged along a column axis, the internal ground pins being aligned with the column axis, the external ground pins being arranged in a column to one side of the column axis.

17. An electrical connector assembly comprising:

a header assembly comprising a header housing, a plurality of header contacts held by the header housing, and a plurality of C-shaped header shields surrounding corresponding header contacts on three sides, the header shields having walls defining the C-shaped header shields and two edges at the ends of the C-shaped header shields; and a receptacle assembly matable to the header assembly, the receptacle assembly comprising:

a front housing matable to the header housing;

a contact module coupled to the front housing, the contact module including a conductive holder having a first side and an opposite second side, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder for electrical termination to corresponding header contacts;

a first ground shield discrete from the conductive holder and coupled to the first side of the conductive holder, the first ground shield being electrically connected to the conductive holder, the first ground shield having grounding beams extending therefrom, the first ground shield having grounding fingers extending therefrom, the grounding beams extending forward of the front of the conductive holder for electrical connection to a corresponding wall of a corresponding header shield, the grounding fingers extending forward of the front of the conductive holder for electrical connection to corresponding edges of the header shield; and a second ground shield discrete from the conductive holder and coupled to the first side of the conductive holder, the second ground shield being electrically connected to the conductive holder, the second ground shield having grounding beams extending therefrom, the second ground shield having grounding fingers extending therefrom, the grounding beams extending forward of the front of the conductive holder for electrical connection to a corresponding wall of a corresponding header shield, the grounding fingers extending forward of the front of the conductive holder for electrical connection to corresponding edges of the header shield.

18. The electrical connector assembly of claim 17, wherein the walls defining the C-shaped header shields include a main wall and opposite side walls extending from opposite sides of the main wall, the side walls include the edges at the distal ends thereof, the grounding beams engaging the corresponding main wall, the grounding fingers of the first ground shield engaging corresponding edges and the grounding fingers of the second ground shield engaging corresponding edges.

19. The electrical connector assembly of claim 17, wherein the first ground shield is coupled to the first side and the second ground shield is coupled to the second side such that the grounding beams and grounding fingers are arranged in sets, each set includes one grounding beam from the first ground shield, one grounding finger from the first ground shield, one grounding beam from the second ground shield and one grounding finger from the second ground shield, each set configured to engage a corresponding header shield at four redundant points of contact.

20. The electrical connector assembly of claim 17, wherein the first ground shield includes ground pins extending from a bottom of the first ground shield, the contacts having contact tails extending from a bottom of the contact module, the contact tails being arranged along a column axis, the ground pins of the first ground shield being aligned with the column axis.

* * * * *